US007204183B2

(12) United States Patent
Cirillo

(10) Patent No.: US 7,204,183 B2
(45) Date of Patent: Apr. 17, 2007

(54) CONTAINER FOR CONTAINING AN EXPLOSION

(76) Inventor: Salvatore Cirillo, 12110 50th Avenue, Montreal, Quebec (CA) H1E 7B7

( * ) Notice: Subject to any disclaimer, the term of this patent is extended or adjusted under 35 U.S.C. 154(b) by 0 days.

(21) Appl. No.: 10/775,076

(22) Filed: Feb. 11, 2004

(65) Prior Publication Data

US 2005/0223881 A1 Oct. 13, 2005

(51) Int. Cl.
*F42B 33/00* (2006.01)
*F42B 39/00* (2006.01)

(52) U.S. Cl. ..... 86/50; 206/3

(58) Field of Classification Search ..... 86/50; 206/3, 594

See application file for complete search history.

(56) References Cited

U.S. PATENT DOCUMENTS 3,093,259 A 6/1963 Morrison
3,648,613 A 3/1972 Cunn
4,389,947 A 6/1983 King et al.
4,574,105 A * 3/1986 Donovan ..... 442/247
4,649,667 A 3/1987 Kitograd
4,879,165 A 11/1989 Smith
5,044,252 A * 9/1991 Gamadi et al. ..... 86/50
5,102,723 A 4/1992 Pepin
5,225,622 A 7/1993 Gettle et al.
5,267,665 A 12/1993 Sanai et al.
5,349,893 A 9/1994 Dunn
5,394,786 A 3/1995 Gettle et al.
5,562,227 A * 10/1996 Takezawa et al. ..... 229/117.13
5,654,053 A 8/1997 Crane et al.
5,864,767 A * 1/1999 Drumgoole et al. ..... 588/313
6,196,107 B1 * 3/2001 Hoffman et al. ..... 86/50
6,341,708 B1 1/2002 Palley et al.
6,439,120 B1 * 8/2002 Bureaux et al. ..... 102/303
6,454,085 B1 * 9/2002 Barker ..... 206/3

* cited by examiner

*Primary Examiner*—Michael J. Carone
*Assistant Examiner*—Bret Hayes
(74) *Attorney, Agent, or Firm*—Ogilvy Renault LLP

(57) ABSTRACT

A container for receiving an explosive element and containing fragments projected by an explosion thereof, the container comprising a seamless enclosure made of walls defining a first open end and a first closed end. The seamless enclosure are collapsible and the walls are formed by a plurality of independent interleaved plies of material, the material and number of plies are selected to contain fragments projected by the explosion. The container also comprises an outer casing having a plurality of first and second panels defining a second enclosure for snugly receiving the seamless enclosure, the first and second panels being rigid, the first panels being hingedly connected to the second panels such that the first panels are movable between a first deployed configuration, where the first panels define a second open end corresponding to the first open end, to a second folded configuration, where the first panels at least partially close the second open end, thereby reducing a height of the outer casing. There is provided a first attachment system on the outer casing for maintaining the first panels in the first deployed configuration when the container is receiving the explosive element, whereby the container is folded for storage by collapsing the seamless enclosure and moving the first panels of the outer casing in the second folded configuration.

14 Claims, 10 Drawing Sheets

CONTAINER FOR CONTAINING AN EXPLOSION

BACKGROUND OF THE INVENTION

1. Field of the Invention

The present invention relates to explosion containment, and more particularly to containers deployable over a potential explosive device such as to contain an explosion thereof.

2. Background Art

There exists an increasing need for protecting people and property from potentially explosive devices such as the ones implemented through terrorist acts. The interest in adequately containing an explosion produced by such a device is two-fold. The first and most obvious interest is to minimize the damage inflicted to the environment in the vicinity of the explosion, the environment potentially including both property and people. The second interest is collecting as much forensic evidence as possible of the components that constituted the explosive device in order to aid in investigation.

Various containers have been disclosed to contain the explosion of such a device. For example, the SPC-500, produced by Bosik Security Containment Systems Ltd. in Canada, is a portable container which is adapted to contain the explosion of a suspect package or letter. However, this container is designed for a relatively small potentially explosive device. In addition, the device needs to be picked up and inserted into the container, which implies a risk of accidental detonation during manipulation.

U.S. Pat. No. 6,341,708 issued Jan. 29, 2002 to Palley et al. discloses a container formed of a series of bands of blast resistant material. The potentially explosive device is either placed in a first band before the band is slid into at least another, or slipped into the at least partially assembled container through a slit. In both cases, and similarly to the SPC-500 container, the manipulation of the device which is necessary for placing it in the container causes a risk of accidental detonation.

U.S. Pat. No. 5,654,053 issued Aug. 5, 1997 to Crane et al. discloses a container for containing an explosion without manipulation of the potentially explosive device. However, the manufacturing process is relatively complex, with multiple steps and necessitating heating to cure some of the materials used. In addition, the container is bulky and thus requires a considerable amount of storage space.

The Universal Containment System, produced by Vanguard Response Systems Inc. in Canada, includes a tent made of ballistic material designed to contain the potentially explosive device and a water-based foam filling the tent and surrounding the explosive to both attenuate the blast of the explosion and extinguish chemical reaction during the explosion. One disadvantage is that use of the foam necessitates an external source of water, as well as equipment such as nozzles and hoses in order for the container to be deployed. A second disadvantage is that the foam tends to destroy forensic evidence that could otherwise be obtained from fragments of the exploded device.

Accordingly, there is a need for a container which can adequately contain an explosive device and an explosion thereof without requiring manipulation of the device and which is easy to use and requires minimal storage space.

SUMMARY OF INVENTION

It is therefore an aim of the present invention to provide an improved container for containing an explosion.

Therefore, in accordance with the present invention, there is provided a container for receiving an explosive element and containing an explosion therein, the container comprising a foldable bag having a first open end and at least one wall defining a first enclosure, each of the at least one wall being composed of a flexible material of a constant thickness capable of containing fragments projected by the explosion, an outer casing having a plurality of first and second panels defining a second enclosure for snugly receiving the foldable bag, the first and second panels being rigid, the first panels being hingedly connected to the second panels such that the first panels are movable between a first deployed configuration, where the first panels define a second open end corresponding to the first open end, to a second folded configuration, where the first panels at least partially close the second open end, thereby reducing a height of the outer casing, and a first attachment system on the outer casing for maintaining the first panels in the first deployed configuration when the container is receiving the explosive element, whereby a necessary storage space for the container is reduced by folding the foldable bag and moving the first panels of the outer casing in the second folded configuration.

Also in accordance with the present invention, there is provided a method for containing an explosive element located on a surface using a container having an outer casing surrounding a foldable impact-resistant bag, the method comprising the steps of unfolding a folded portion of the outer casing such as to obtain a deployed configuration defining a first open end in the outer casing, engaging an attachment system such as to retain the outer casing in the deployed configuration, unfolding the foldable bag such as to define a second open end in the foldable bag corresponding with the first open end in the outer casing, and lowering the container on the explosive element such that the explosive element is enclosed in the container with the first and second open end being effectively closed by the surface.

Further in accordance with the present invention, there is provided a container for receiving an explosive element and containing fragments projected by an explosion thereof, the container comprising a plurality of walls defining an enclosure with one open end, the plurality of walls being composed of a material of a constant thickness capable of containing fragments projected by the explosion, the material in each of the plurality of walls being formed of a plurality of layers such that each layer is continuous with at least one layer in an adjacent one of the plurality of walls to provide an at least partial continuity of the layers between adjacent walls.

Further yet in accordance with the present invention, there is provided a method for manufacturing a container for receiving an explosive element and containing fragments projected by an explosion thereof, the method comprising the steps of providing a prismatic support having a top wall, a first side wall, a second side wall adjacent to the first side wall, a third side wall opposed to the first side wall, and a fourth side wall opposed to the second side wall, providing first, second and third strips of a material capable of containing fragments projected by the explosion, the first strip having a width generally equal to a width of the first side wall, the second strip having a width generally equal to a width of the second side wall, and the third strip having a width generally equal to a height of the container, wrapping the first strip such as to subsequently cover the first side wall, top wall and third side wall, wrapping the second strip such as to subsequently cover the second side wall, top wall and fourth side wall, wrapping the third strip around the support such as to subsequently cover the first, second, third and fourth side walls, wrapping the first strip back such as to subsequently cover the third side wall, top wall and first side wall, wrapping the second strip back such as to subsequently cover the fourth side wall, top wall and second side wall, wrapping the third strip again around the support such as to subsequently cover the first, second, third and fourth side walls, and repeating the wrapping steps until a desired thickness of material is obtained over each wall such as to define the container.

BRIEF DESCRIPTION OF THE DRAWINGS

Reference will now be made to the accompanying drawings, showing by way of illustration a preferred embodiment thereof and in which.

DESCRIPTION OF THE PREFERRED EMBODIMENTS

Figure 1:
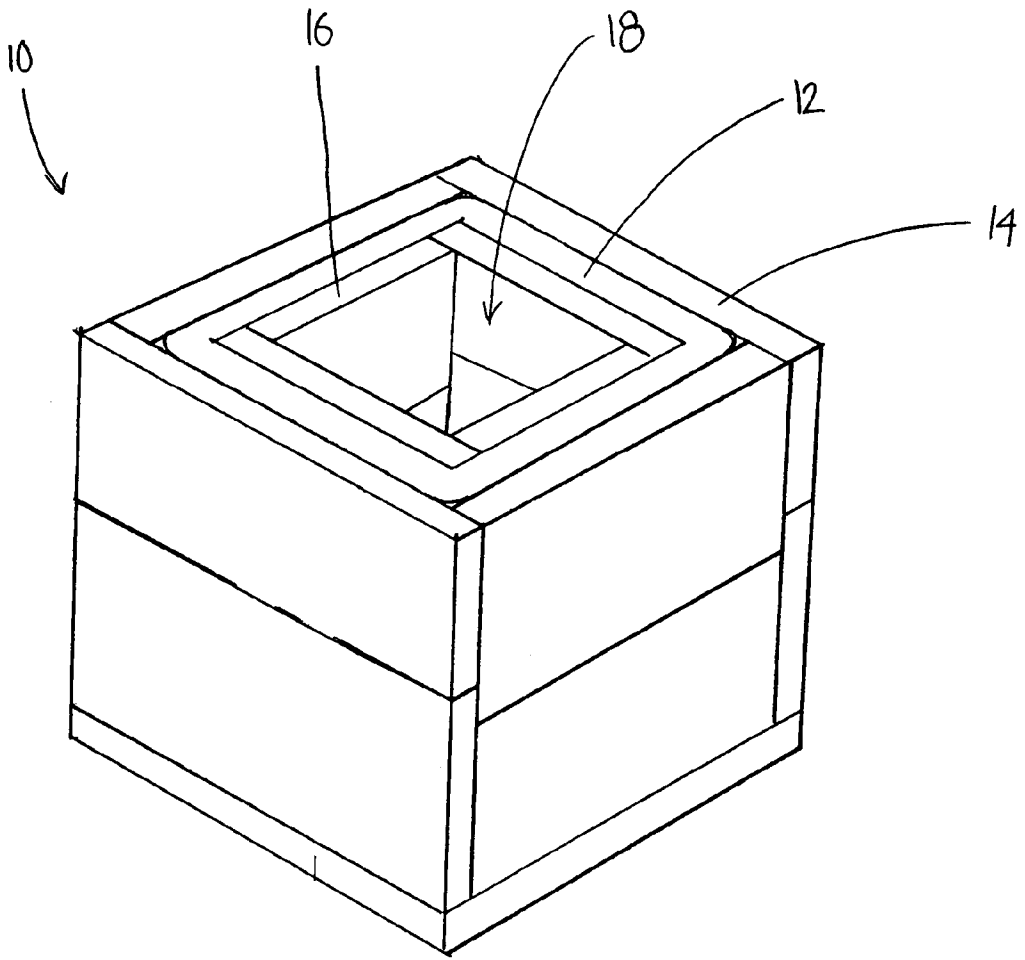
FIG. 1 is a perspective view of a container according to a preferred embodiment of the present invention, the container being depicted with the top side down.
Figure 2:
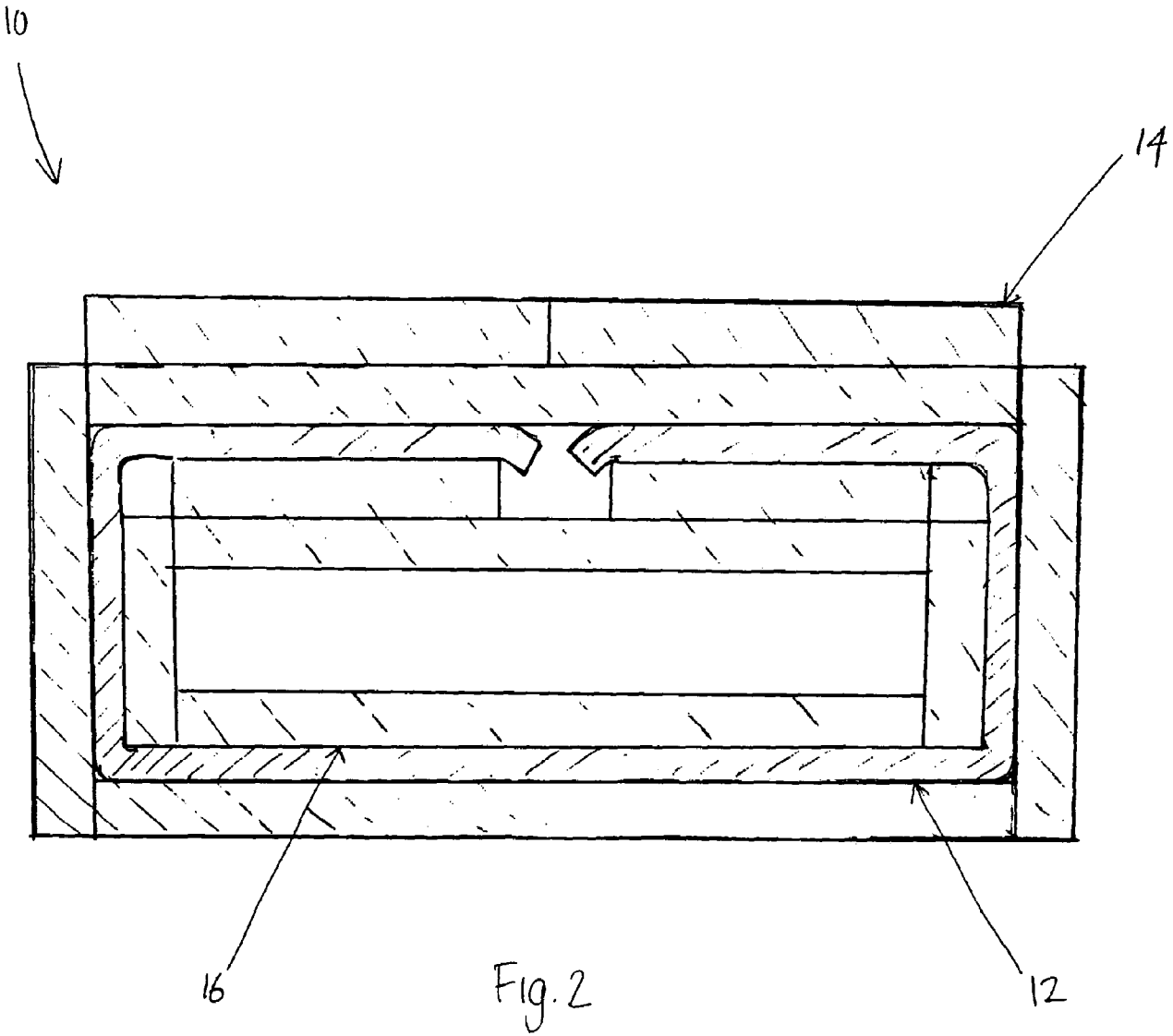
FIG. 2 is a side cross-sectional view of the container in FIG. 1, top side down and in a folded configuration.

Referring now to FIG. 1, a container generally indicated at 10 comprises a bag 12 which is surrounded by an outer casing 14 and contains an inner casing 16. The container 10, which is shown top side down in FIG. 1, is preferably prismatic in shape with four (4) closed sides, a closed top and a bottom open end 18. The container 10 is partly foldable, as shown in FIG. 2 and as will be detailed further below. In a preferred embodiment, the container 10 is 32 inches wide by 32 inches deep by 24 inches high. It is also considered to provide containers of various sizes to accommodate various types of explosive devices.

Figure 3:
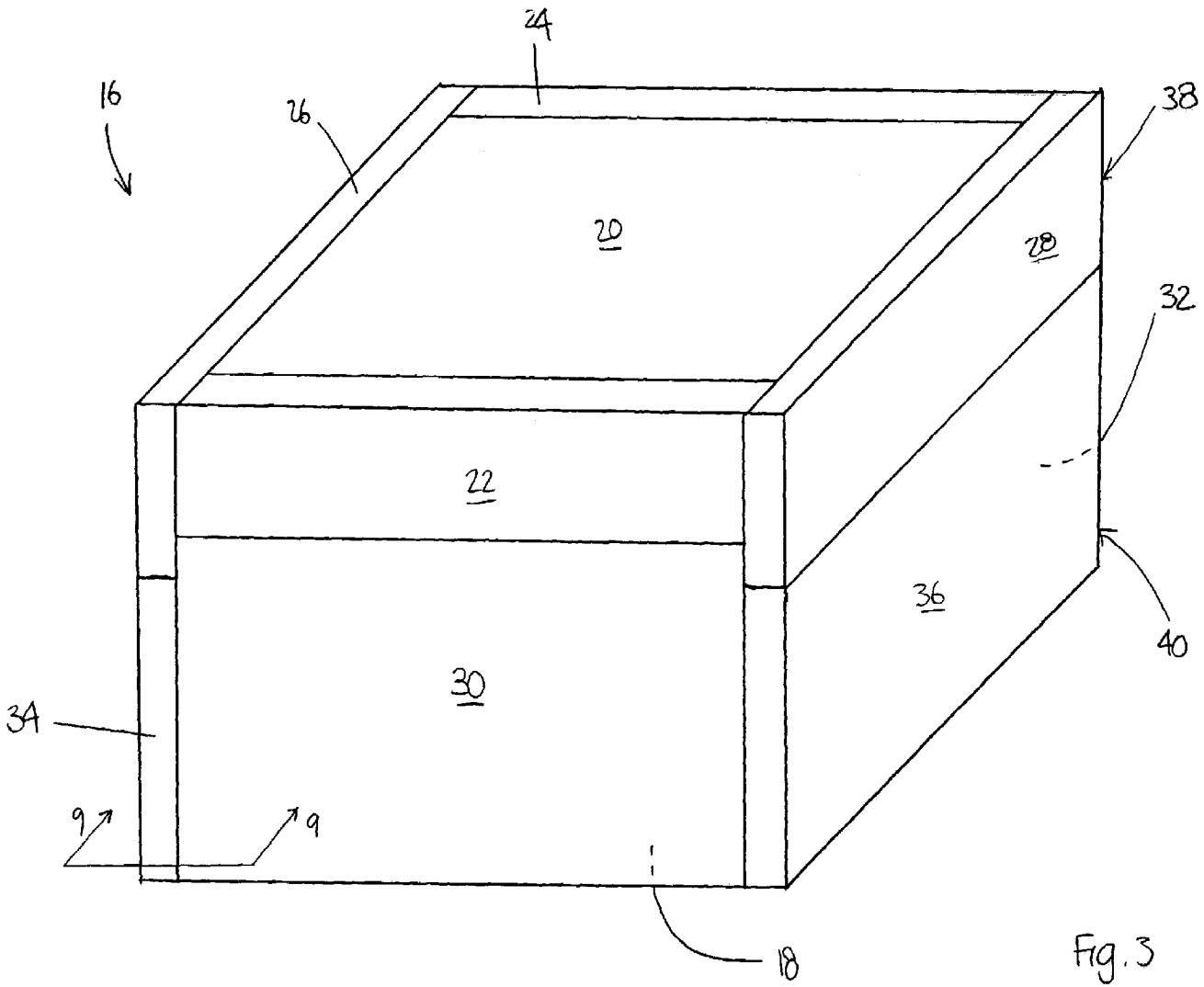
FIG. 3 is a perspective view of an inner casing of the container of FIG. 1, the inner casing being depicted with the top side up.
Figure 9:
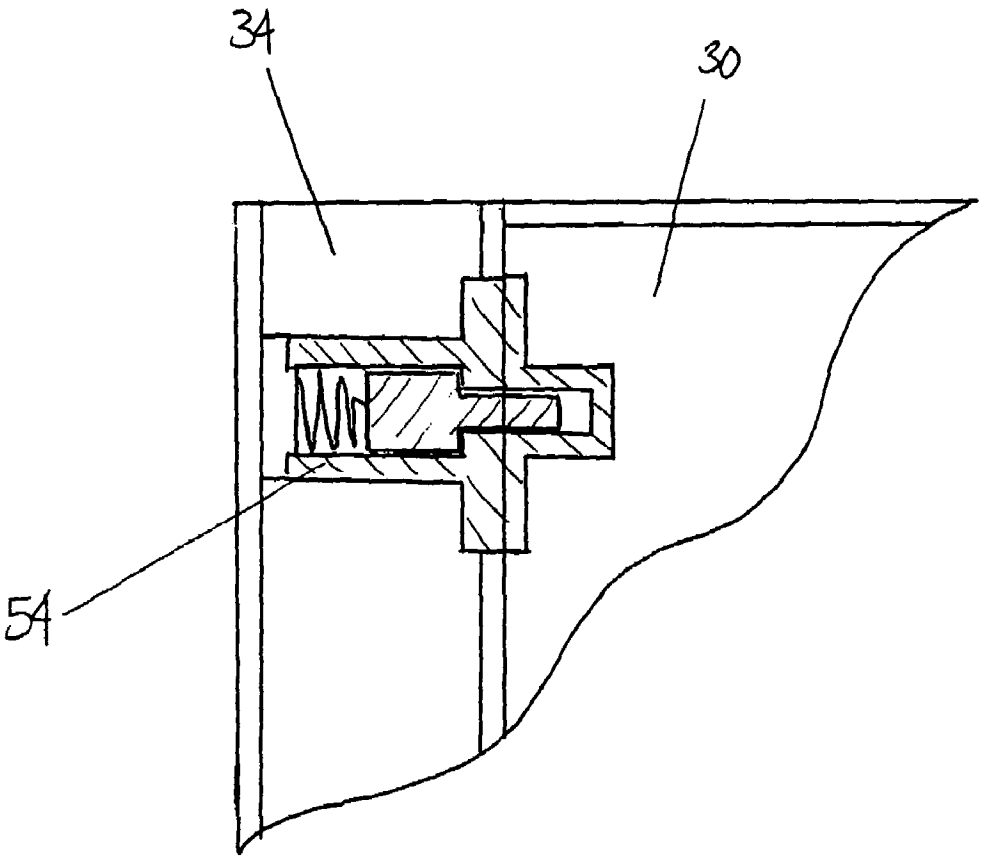
FIG. 9 is a partial cross-section of the inner casing of FIG. 3 taken along lines 9—9 in order to show an attachment system between adjacent panels of the casing.

Referring to FIG. 3, the inner casing 16 comprises a top panel 20 having one edge connected to a first side panel 22 at right angle and an opposite edge connected to a second side panel 24 at right angle. A third side panel 26 is perpendicularly connected to one of the remaining edges of the top panel 20 as well as to adjacent ends of the first and second panels 22, 24. A fourth side panel 28 is similarly connected to the other of the remaining edges of the top panel 20 as well as to the opposite ends of the first and second panels 22, 24. The third and fourth side panels 26, 28 have a greater height than the first and second side panels 22, 24, the height differential corresponding to at least a thickness of the first and second side panels 22, 24. First, second, third and fourth foldable panels 30, 32, 34, 36 are respectively hingedly connected to the first, second, third and fourth side panels 22, 24, 26, 28 such as to extend in as a continuation of the respective side panel. The hinge connection between the panels is preferably made through fabric tape since metallic hinges would likely produce shrapnel during an explosion. The first and second foldable panels 30, 32 have a greater height than the third and fourth foldable panels 34, 36 such as to have all bottom edges of the foldable panels 30, 32, 34, 36 in the same plane and surrounding the open bottom end 18. The inner casing thus takes the form of a box having a top rigid portion 38, composed of panels 22, 24, 26, 28, and a bottom foldable portion 40, composed of panels 30, 32, 34, 36. The foldable panels 30, 32, 34, 36 are retained in a deployed configuration by an attachment system, one example of which is a conventional spring load latch 54 installed between adjacent foldable panels, as illustrated in FIG. 9.

Figure 4:
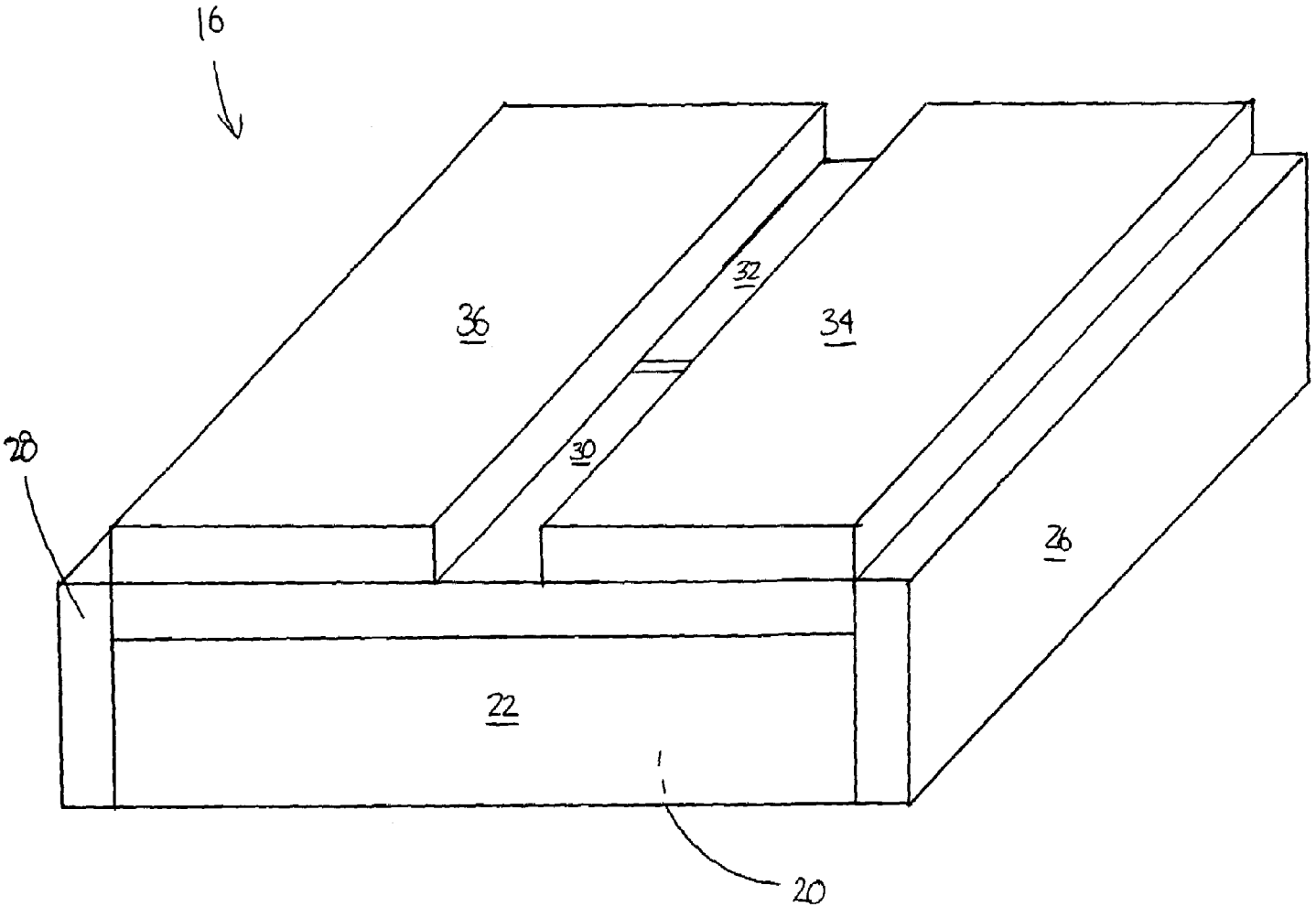
FIG. 4 is a perspective view of the inner casing of FIG. 3, with the top side down and in a folded configuration.

FIG. 4 shows the collapsed inner casing, shown top side down for ease of illustration. The panels 30, 32, 34, 36 are shown folded from the side panels 22, 24, 26, 28 at right angles to partially cover the open bottom end 18. The first and second panels 30, 32 are folded first, and the third and fourth panels 34, 36 are folded on top of the first and second panels 30, 32. This allows for an effective height reduction of the inner casing without increasing the width or the length thereof.

The top panel 20, side panels 22, 24, 26, 28 and foldable panels 30, 32, 34, 36 are made of a blast mitigation material which effectively reduces the strength of the blast of an explosive device in close proximity. Examples of such materials are disclosed by Gettle et al. in U.S. Pat. Nos. 5,225,622 and 5,394,786, which are both incorporated herein by reference. The mitigation mechanism of such materials is a combination of mechanical and chemical factors that stop the chemical reaction of the explosive before the entire explosive is consumed. A portion of the remainder of the explosive force is mitigated as it passes through the material. In a preferred embodiment, the panels are made from lightweight honeycomb filled with attenuating filler material and sealed off on both sides with a thin relatively friable tissue, and are roughly 2 inches thick. The role of the mitigating inner casing 16 is to enhance the effectiveness of the container 10 by reducing the intensity of the shock wave and the amount of gas produced by the explosion. The overall thickness of the load bearing walls of the container can thus be reduced, advantageously affecting the weight and cost of the container.

The bag 12 is a seamless enclosure made of a suitable lightweight impact-resistant material that can stop high-energy projectiles such as bullets or shrapnel from an exploding bomb. In order to minimize bag weight and thickness, preferred materials are of the type made of extended chain polyethylene such as Spectra ® made by Honeywell International Inc. in U.S.A and Dynema™ made by DSM N.V. in The Netherlands. Other materials such as those based on aramid could also be used but would require a thicker and heavier bag for containment of the same explosive device due to their inferior ballistic properties.

The bag 12 or seamless enclosure is formed by a plurality of independent interleaved plies, typically of woven material. Naturally, the material and number of plies are selected to contain fragments projected by an explosion as aforementioned. Preferably, the interleaved plies of impact-resistant material are contained within a fabric envelope 44 (FIG. 6) that will be described further on. A preferred material for the fabric envelope is nylon.

Figure 5:
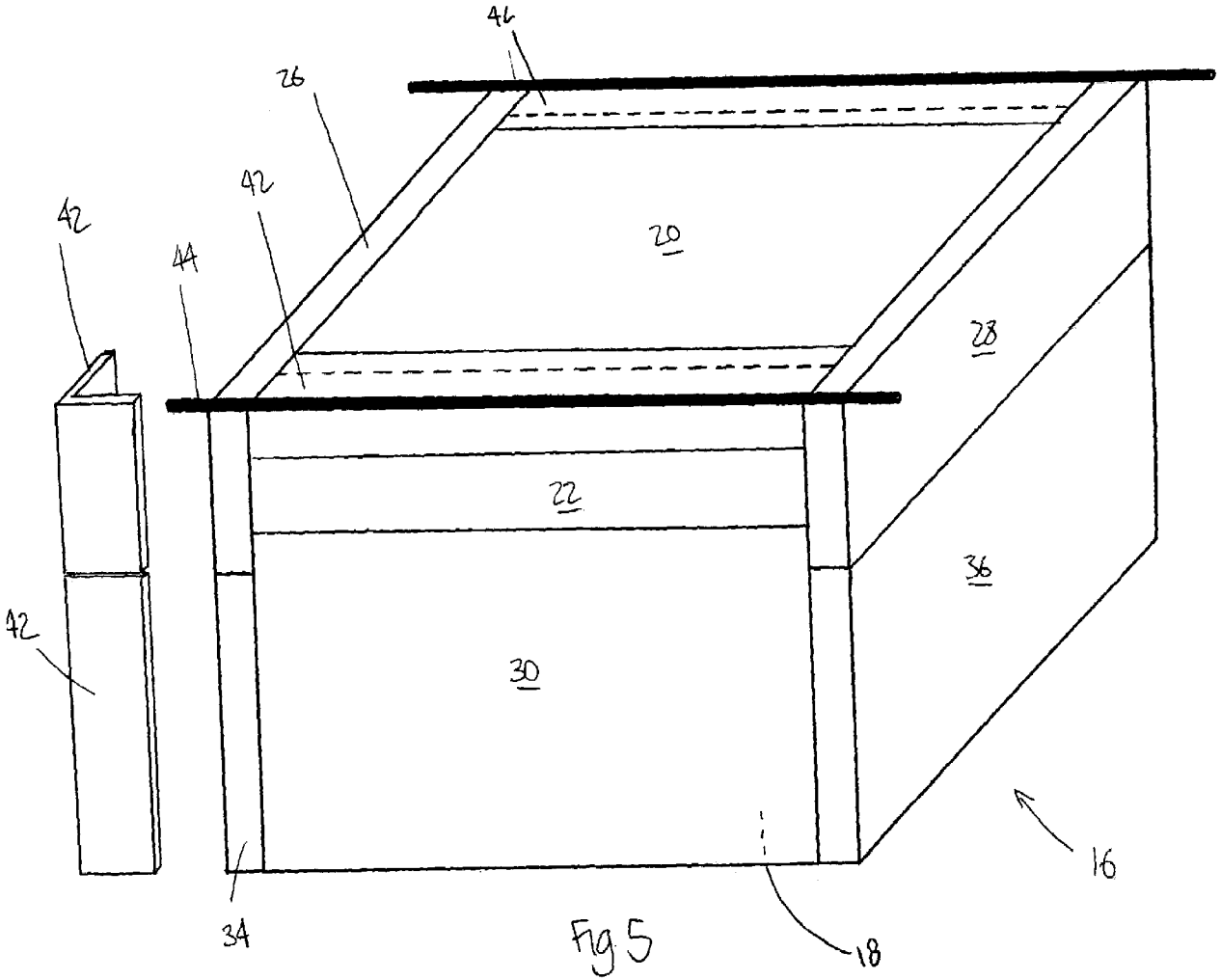
FIG. 5 is a perspective view of the inner casing of FIG. 3 showing the installation of a pair of rods and of corner pieces.

While the bag 12 can be separately formed over a prismatic mold, it is preferably formed directly on the inner casing 14 to reduce time and costs of manufacturing. Referring to FIG. 5, corner pieces 42 are made of impact-resistant material and glued onto each of the eight (8) corners of the inner casing 16. The corner pieces 42 are preferably laminated for rigidity, with separate corner pieces for the corners between side panels and for the corners between foldable panels. The corner pieces 42 need to be small enough so as not to hinder the folding of the inner casing 16. A pair of rods 43 are attached to opposite top corners of the inner casing 16 to retain the bag 12 and outer casing 14.

Figure 6:
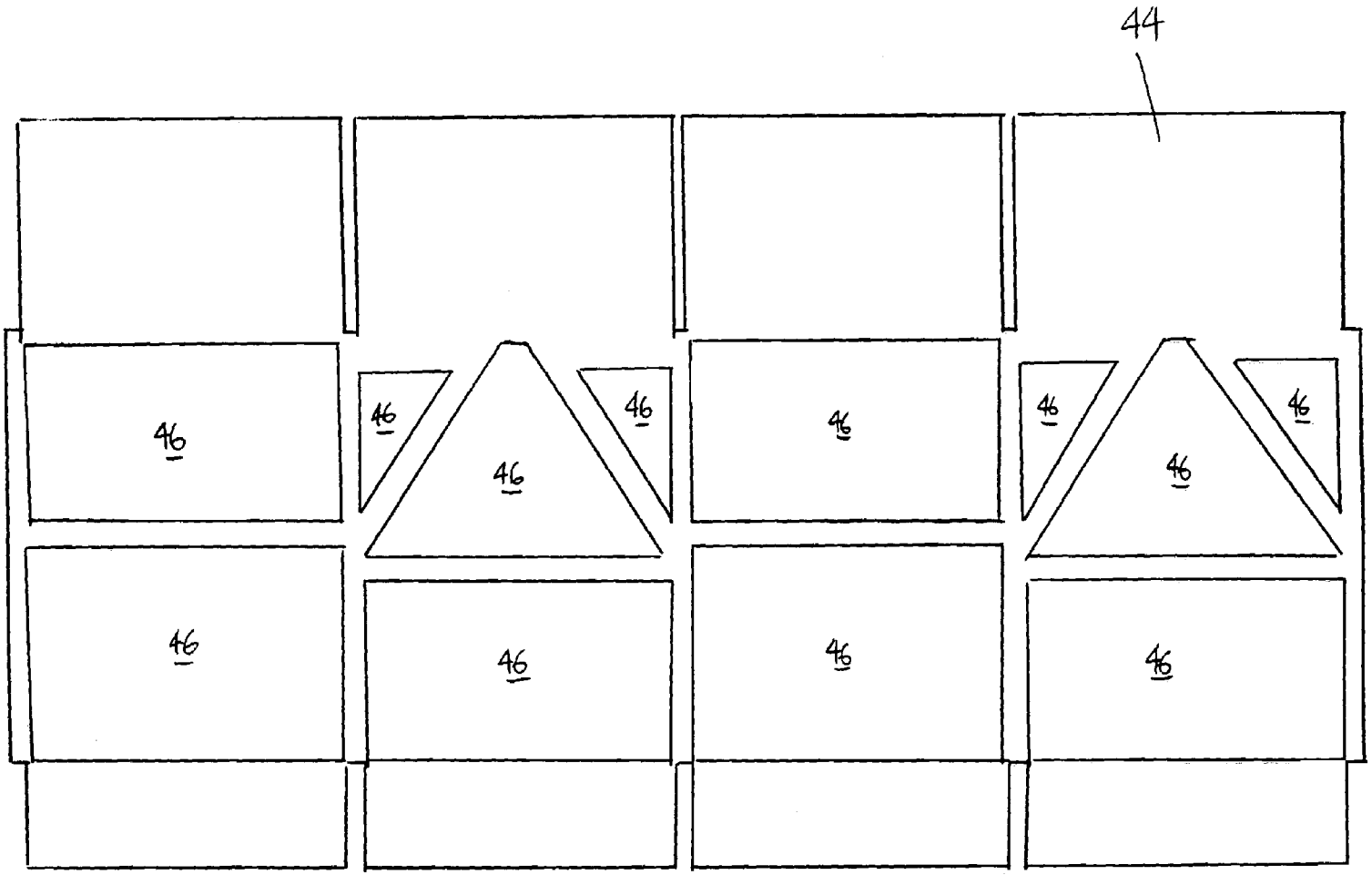
FIG. 6 is a plan view of an unfolded inner portion of a fabric envelope of a bag of the container of FIG. 1.
Figure 7:
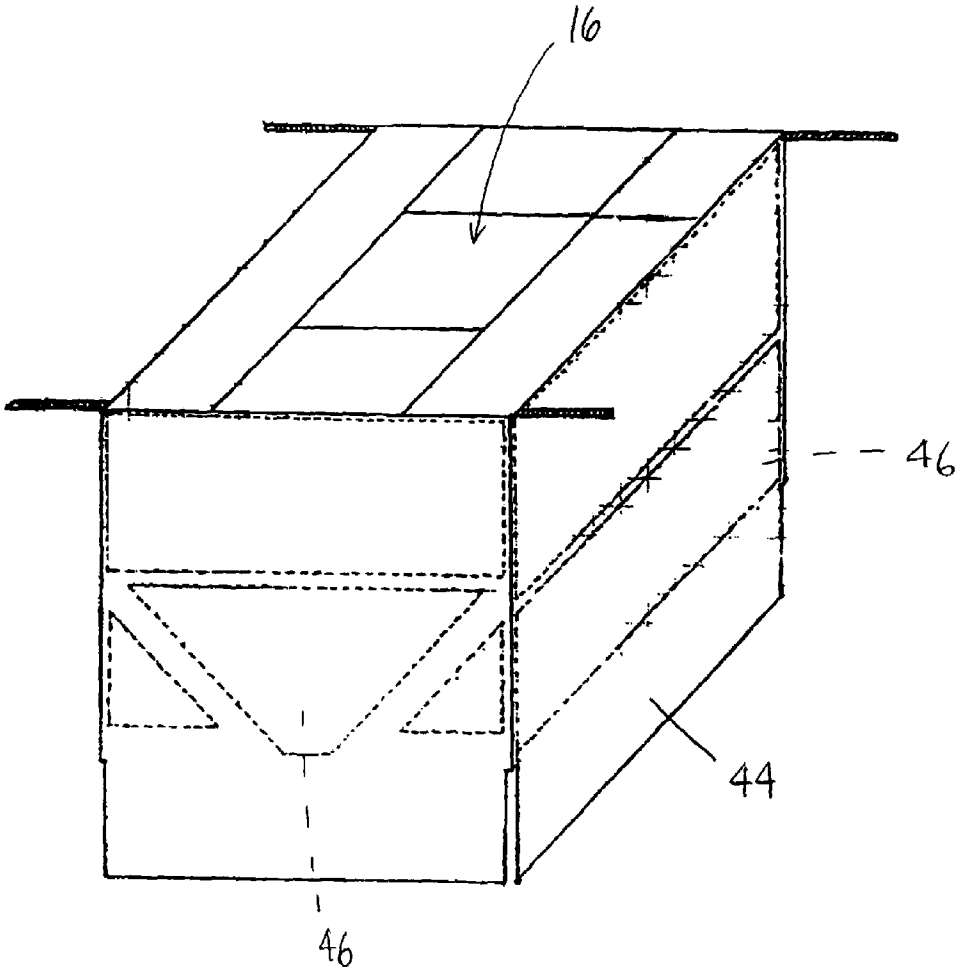
FIG. 7 is a perspective view of the inner casing of FIG. 5 covered with the inner portion of the fabric envelope of FIG. 6.

Referring to FIG. 6, an inner portion of the fabric envelope 44 designed to contain the impact-resistant material of the bag 12 is shown. A plurality of semi-rigid reinforced shapes 46 are stitched onto the envelope 44 to give a certain rigidity to the bag 12 while allowing for easy folding thereof. The reinforced shapes 46 are preferably made of plastic or hard paper covered with the fabric forming the envelope 44. Referring to FIG. 7, the inner portion of the fabric envelope 44 is positioned over the sides and top panel of the inner casing 16, with the reinforced shapes 46 facing inward, and attached to the rods 43.

Figure 8A:
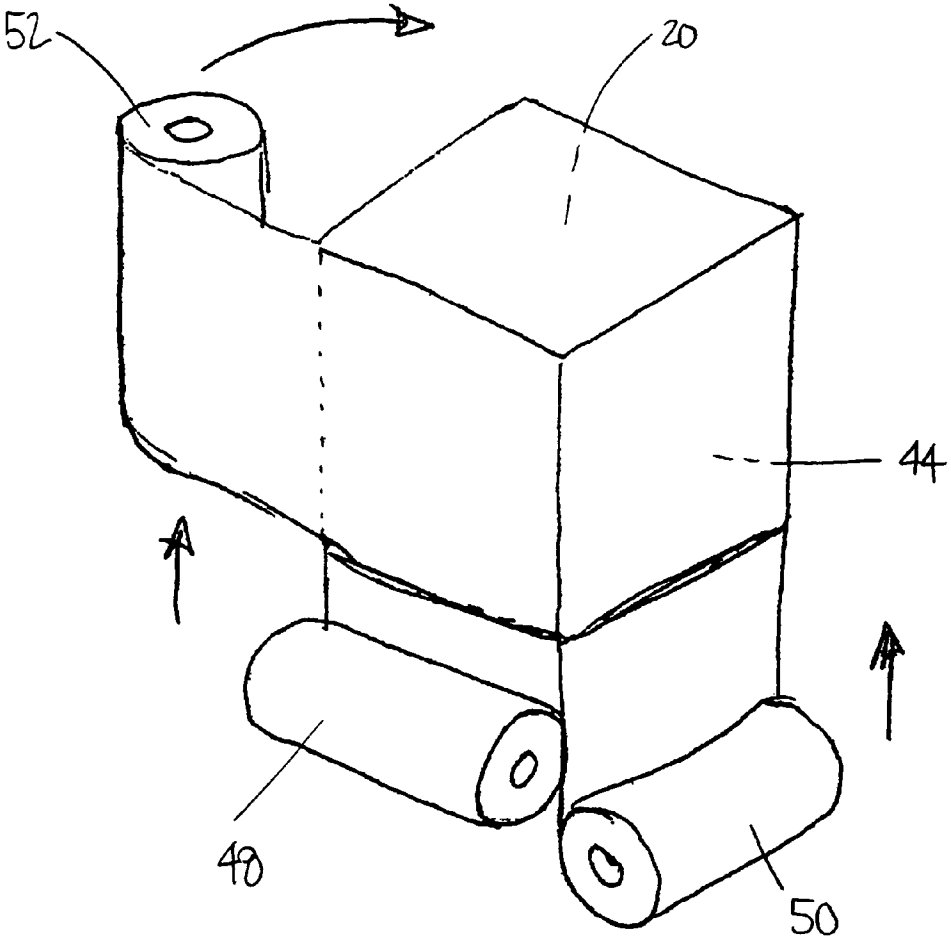
FIGS. 8*a* and *b* are perspective views showing the wrapping of the inner casing of FIG. 7 in impact-resistant material in order to form the bag of the container of FIG. 1.
Figure 8B:
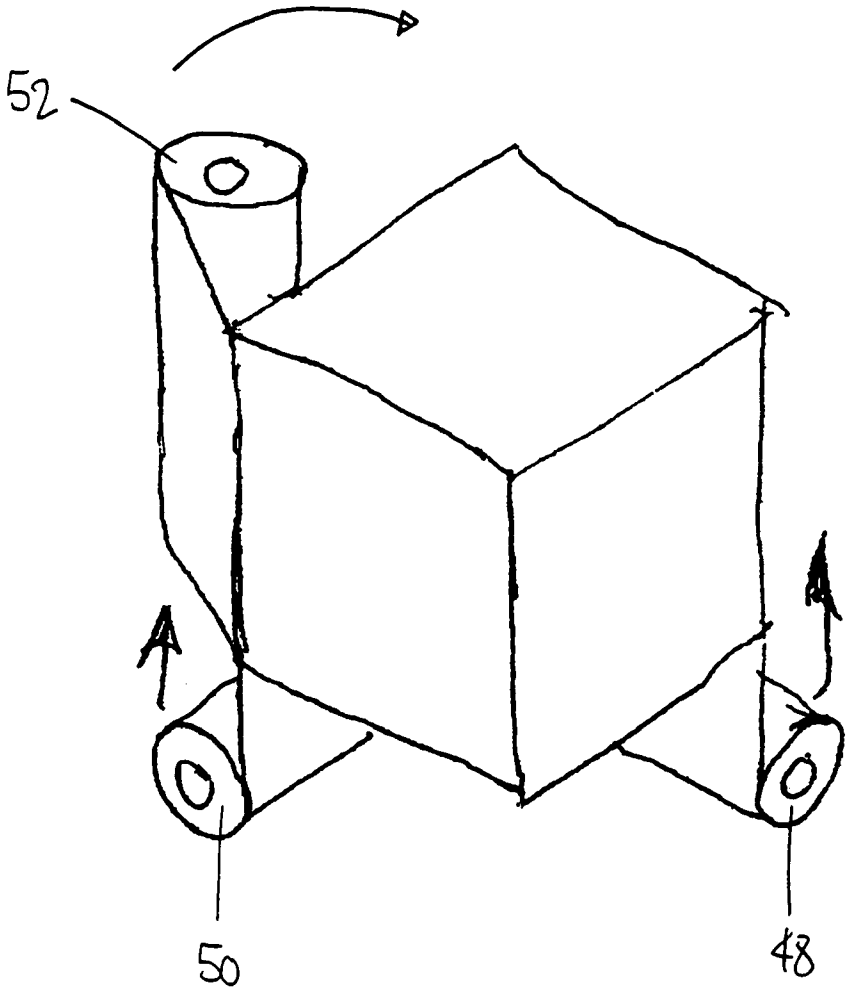

Referring to FIGS. 8*a*-8*b*, the impact-resistant material is provided in a continuous fabric form on first, second and third rolls 48,50,52. The impact-resistant material is wrapped around the inner casing 16 covered with the inner portion of the fabric envelope 44 according to the following. First, the material from the first roll 48 and the second roll 50 are connected to the inner portion of the fabric envelope 44 along adjacent bottom edges. The material from the third roll 52 is connected along a side edge, perpendicularly to the first and second rolls 48,50. The first roll 48 is brought upwards, over the top panel 20 and downwards, such as to cover opposite sides and the top edge 20 with one layer of material. The second roll 50 is then also brought upwards, over the top panel 20 and downwards, such as to cover the other opposite sides and the top edge 20 with one layer of material. Finally, the third roll 52 is brought around the inner casing 16 for a complete turn, such as to cover all sides with a layer of material.

The first, second and third rolls 48,50,52 have thus been brought from a first position illustrated in FIG. 8*a* to a second position illustrated in FIG. 8*b*. First and second rolls 48,50 are then successively returned to their original position before the third roll 52 is brought around the inner casing 16 for another complete turn, thereby completing a cycle.

At the end of this cycle, each side as well as the top panel are covered with four (4) layers of material, with two layers extending in a first direction and two others extending in a second direction perpendicular to the first direction. All edges between adjacent sides and between the sides and top panel are covered with only two layers. This is compensated by the corner pieces 42 that are installed on the inner casing 16 under the fabric envelope 44 (see FIG. 5). Thus, the cycle is repeated until a desired number of layers is reached, and the corner pieces 42 make up half of the desired number of layers on the edges allowing for an overall constant thickness.

In a preferred embodiment, each layer of material is composed of two plies of extended chain polyethylene fiber fabric having an orientation of [0°/90°], and a total of 90 layers is applied on the sides and top. Once the desired number of layers is reached, an outer portion of the fabric envelope (not shown) is disposed over the impact-resistant material and suitably attached, such as by sewing, to the inner portion of the fabric envelope. Therefore the impact-resistant material,is completely enclosed and contained thereby forming walls defining the seamless enclosure.

The wrapping process of the impact-resistant material will produce a weaving effect of the layers, which will help the bag 12 to remain whole after an explosion. By contrast, a bag made from separate layers of material would tend to be separated by the force of the blast, which would make the bag inefficient to contain shrapnel.

The resulting bag 12 is thus prismatic in shape, with an open bottom end 18, walls having an equivalent thickness of impact-resistant material, and continuous corners, i.e. without mechanical attachments such as hinges to hold the walls together. Bolted, riveted, or hinged joints between adjacent walls of a container inherently introduce stress concentrations that can be the source of failure of the container during an explosion, and provide fragments that can be propelled by the explosion if the joints fail. By having joints made of impact-resistant material that are at least partially continuous with the adjacent walls, the stress distribution in the bag 12 is optimized, and the bag 12 is lighter than an equivalent bag having metallic joints. Also, the joints of the present invention form no opening by which shrapnel produced by the explosion could escape.

Alternative fabrication methods are also considered to produce the bag 12 including, but not limited to, filament or tape winding, as long as all the walls of the finished bag 12 have an equivalent material thickness and all joints are at least partly continuous with adjacent walls in order to obtain an adequate stress distribution in the bag.

The outer casing 14 is manufactured in the same manner as described for the inner casing 16 (see FIGS. 3–4) with a top panel, a rigid portion composed of four side panels, and a foldable portion composed of four foldable panels, each one hingedly connected to one of the four side panels. This is illustrated in FIG. 2, where the assembled container 10 is shown in a folded position. The foldable panels are retained in a deployed configuration with the help of the attachment system 54 shown in FIG. 9. The outer casing 14 is assembled such as to be retained on the rods 44 connected to the inner casing 16, to insure integrality of the container 10. The primary function of the outer casing 14 is to facilitate manipulating of the container 10. Thus, it can be made from a rigid but relatively light material, such as sandwich panels made of a Styrofoam core between two thin sheets of corrugated polyethylene. In addition, the outer casing 14 can incorporate at strategic locations a number of handles and wheels (not shown) to facilitate lifting and moving by a single person or even by a remotely controlled robot.

The container 10 presents several advantages, one of which being its low weight. Since the extended chain polyethylene fiber material has a strength to weight ratio which is reported to be in the range of 8 to 10 times that of steel, and both the blast mitigation panels of the inner casing and the panels of the outer casing are relatively light, the container 10 is considerably lighter than an equivalent container made of steel. For example, a container designed to completely contain a blast and shrapnel produced by a pipe bomb having a diameter of 2 inches, a length of 12 inches and containing half a pound of black gun powder can weigh as little as 120 pounds when fully assembled. Such a container can easily be transported by two operators. An equivalent steel container could weight as much as 1000 pounds or more, and thus would require special equipment in order to be transported.

Yet another advantage of the container 10 is the ability of the container to be folded, due to the foldable portions of the inner and outer casing, and to the foldable property of the impact-resistant bag. This effectively reduces the storage space necessary for the container, which can be a considerable advantage in numerous situations where such a container needs to be stored in a limited space, for example a police car trunk or a closet in an airport or a post office.

In addition, the folded container is easily deployed and quickly readied for use. In a preferred embodiment, the folded container can be deployed in less than one minute. The open bottom allows for the container to be simply lowered over the explosive device, effectively enclosing it without manipulating the device. This reduces the risk of accidental detonation occurring during the deployment of the container. With the use of hooks or the like on the outer casing, the container 10 becomes very easy to deploy through the use of a robot, thus further minimizing the risk of injury during deployment.

The container 10 also acts to contain gas produced by the explosion and as such will absorb a majority of the noise produced.

In an alternative embodiment, it is considered to provide a container composed of an outer casing 14 and bag 12 only. In this case, the impact-resistant material forming the bag 12 would have to be wrapped around a mold of appropriate size and shape in order to form the bag walls, then removed from the mold and attached inside the outer casing 14. This container could be used as is or in combination with other blast mitigation means, such as foam similar to that used in the Universal Containment System of Vanguard Response Systems Inc. previously described. A significant advantage of using such foam is that neutralizing agents can be added to the foam in order to mitigate the effects of a chemical or biological threat in an explosive device. In this case, the container can be designed integrally with the foaming medium and its own sufficient source of water, the mixing of which can be deployable remotely by radio-control or other such means. Additionally, these or other means of mitigation could be combined in the container to better exploit the advantages of each method.

In another alternative embodiment, it is considered to provide a container composed solely of the bag 12. While the bag 12 is foldable, the impact-resistant material still possesses sufficient rigidity to allow the bag 12 to maintain its shape when deployed alone. As in the previous alternative embodiment, the impact-resistant material forming the bag 12 would have to be wrapped around a mold of appropriate size and shape in order to form the bag walls, then be removed from that mold. Although a little harder to manipulate than the embodiments with an outer casing, this embodiment can still be easily transported and deployed over the explosive device. Since no attachment systems are used, this embodiment can be deployed quicker than the previous embodiments. In addition, the container according to this embodiment necessitates less storage space than the previous embodiments because of the completely foldable quality of the impact-resistant material, which can adapt to a variety of storage space configurations.

It is further considered to provide an embodiment where the multi-layered bag 12 is laminated after the impact-resistant material is wrapped using the wrapping technique described. This laminated bag 12 can be used alone or with inner and/or outer casings, although in this embodiment, the container 10 is not foldable. The laminated bag 12 used alone is easy to manipulate, can integrate wheels and/or hooks to facilitate deployment by a robot, and will effectively contain shrapnel from an explosion.

It is also considered to provide containers having an alternative shape, for example cylindrical or semi-spherical containers. The materials used for the inner casing and outer casing can easily be adapted to form rounded panels. In addition, cylindrical or semi-spherical bags of impact-resistant material can be manufactured in a continuous manner through known techniques, one of which being filament winding, producing a bag having a uniform thickness of material at all points.

The embodiments of the invention described above are intended to be exemplary. Those skilled in the art will therefore appreciate that the forgoing description is illustrative only, and that various alternatives and modifications can be devised without departing from the spirit of the present invention. Accordingly, the present is intended to embrace all such alternatives, modifications and variances which fall within the scope of the appended claims.

I claim:

1. A container for receiving an explosive element and containing fragments projected by an explosion thereof, the container comprising:

a seamless enclosure made of walls defining a first open end and a first closed end , the seamless enclosure being collapsible, the walls are formed by a plurality of independent interleaved plies of material, the material and number of plies are selected to contain fragments projected by the explosion;

an outer casing having a plurality of first and second panels defining a second enclosure for snugly receiving the seamless enclosure, the first and second panels being rigid, the first panels being hingedly connected to the second panels such that the first panels are movable between a first deployed configuration, where the first panels define a second open end corresponding to the first open end, to a second folded configuration, where the first panels at least partially close the second open end, thereby reducing a height of the outer casing; and a first attachment system on the outer casing for maintaining the first panels in the first deployed configuration when the container is receiving the explosive element;

an inner casing snugly surrounded by the seamless enclosure, the inner easing having a plurality of third and fourth panels defining a third enclosure, the third and fourth panels being composed of a blast mitigation material significantly reducing a strength of a blast produced by the explosion before the blast reaches the seamless enclosure, the third panels being hingedly connected to the fourth panels such that the third panels are movable between a third deployed configuration, where the third panels define a third open end corresponding to the first open end, to a fourth folded configuration, where the third panels at least partially close the third open end thereby reducing a height of the inner casing; and a second attachment system an the inner casing for maintaining the third panels in the third deployed configuration when the container is receiving the explosive element;

whereby the container is folded for storage by collapsing the seamless enclosure and moving the first panels of the outer casing in the second folded configuration, and the first panels of the outer casing can be moved in the second folded configuration at least when the third panels of the inner casing are in the fourth folded configuration.

2. The container according to claim 1, wherein the first and second panels of the outer casing are composed of a rigid foam core sandwiched between two sheets of polyethylene.

3. The container according to claim 1, wherein the outer casing and seamless enclosure have a prismatic shape.

4. The container according to claim 1, wherein the outer casing, seamless enclosure and inner casing have a prismatic shape.

5. A method for manufacturing a container for receiving an explosive element and containing fragments projected by an explosion thereof, the method comprising the steps of:

providing a prismatic support having a top wall, a first side wall, a second side wall adjacent to the first side wall, a third side wall opposed to the first side wall, and a fourth side wall opposed to the second side wall;

providing first, second and third strips of a material selected to contain fragments projected by the explosion, the first strip having a width generally equal to a width of the first side wall, the second strip having a width generally equal to a width of the second side wall, and the third strip having a width generally equal to a height of the container;

wrapping the first strip such as to subsequently cover the first side wall, top wall and third side wall;

wrapping the second strip such as to subsequently cover the second side wall, top wall and fourth side wall;

wrapping the third strip around the support such as to subsequently cover the first, second, third and fourth side walls;

wrapping the first strip back such as to subsequently cover the third side wall, top wall and first side wall;

wrapping the second ship back such as to subsequently cover the fourth side wall, top wall and second side wall;

wrapping the third strip again around the support such as to subsequently cover the first, second, third and fourth side walls; and repeating the wrapping steps until a desired thickness of material is obtained over each wall thereby defining the container.

6. A method according to claim 5, wherein after a desired thickness of material is obtained, the container is laminated For rigidity.

7. A container for receiving an explosive element and containing fragments projected by an explosion thereof, the container having a prismatic shape comprising a seamless enclosure formed by a top wall and first and second pairs of opposed side walls defining an open end and a closed end, the walls being formed by a plurality of independent interleaved plies of material, the material and number of plies being selected to contain fragments projected by the explosion, the interleaved plies of material comprising first, second and third elongated strips of material, the first elongated strip continuously forming plies of the top wall and plies of the first pair of opposed side walls, the second elongated strip continuously forming alternating plies of the top wall and plies of the second pair of opposed side walls, the third elongated strip continuously forming alternating plies of the first and second pair of opposed side walls, the first, second and third elongates strips interleaved such that each of the first, second and third elongated strips forms a continuity of overlapping layers.

8. The container according to claim 7, wherein the material is an extended chain polyethylene fabric.

9. The container according to claim 7, wherein the material is flexible such that the container is collapsible.

10. The container according to claim 7, wherein the material is an extended chain polyethylene fabric.

11. The container according to claim 7, wherein the interleaved plies of material extend in alternating orientations, orthogonal to each other.

12. The container according to claim 11, wherein the interleaved plies of material are in the form of elongated flexible woven strips.

13. The container according to claim 12, wherein the seamless enclosure is a collapsible bag.

14. The container according to claim 13, wherein the walls making up the enclosure have a constant thickness.

* * * * *